United States Patent [19]

Atkinson

[11] 3,952,559

[45] Apr. 27, 1976

[54] EXPOSED SHACKLE PADLOCK

[75] Inventor: Wallace E. Atkinson, Petersburg, Va.

[73] Assignee: Long Manufacturing Co., Inc., Petersburg, Va.

[22] Filed: May 10, 1974

[21] Appl. No.: 469,039

[52] U.S. Cl. ..... 70/25; 70/38 B

[51] Int. Cl.[2] ..... E05B 37/10; E05B 67/22; E05B 67/24

[58] Field of Search ..... 70/21, 25, 38, 314

[56] References Cited

UNITED STATES PATENTS

| | | | |
|---|---|---|---|
| 1,888,647 | 11/1932 | Winning | 70/25 |
| 2,148,226 | 2/1939 | Aldeen | 70/25 |
| 2,154,660 | 4/1939 | Brauning | 70/314 X |
| 2,173,720 | 9/1939 | Marshall et al. | 70/25 |
| 3,009,345 | 11/1961 | Check | 70/21 |
| 3,518,852 | 7/1970 | Orr | 70/25 |
| 3,563,067 | 2/1971 | Foote | 70/25 |

*Primary Examiner*—Paul R. Gilliam
*Assistant Examiner*—Carl F. Pietruszka
*Attorney, Agent, or Firm*—Mason, Fenwick & Lawrence

[57] ABSTRACT

An exposed shackle padlock including a casing and a U-shaped shackle movable between an outer open position and an inner locked position. A fence plate is supported for rocking movement within the casing about a pivot lug between locking and unlocking relations with a notch in a shorter leg of the shackle. One or more peripherally gated rotatable tumbler wheel members adjacent a fence formation on the fence plate normally prevent its movement to the unlocking position and may form either a key operated locking mechanism or a dial operated combination locking mechanism. The tumbler members in the combination lock form are scrambled during opening movement of the shackle and the fence plate is displaceable relative to the pivot lug to permit return of the shackle to locked position.

29 Claims, 15 Drawing Figures

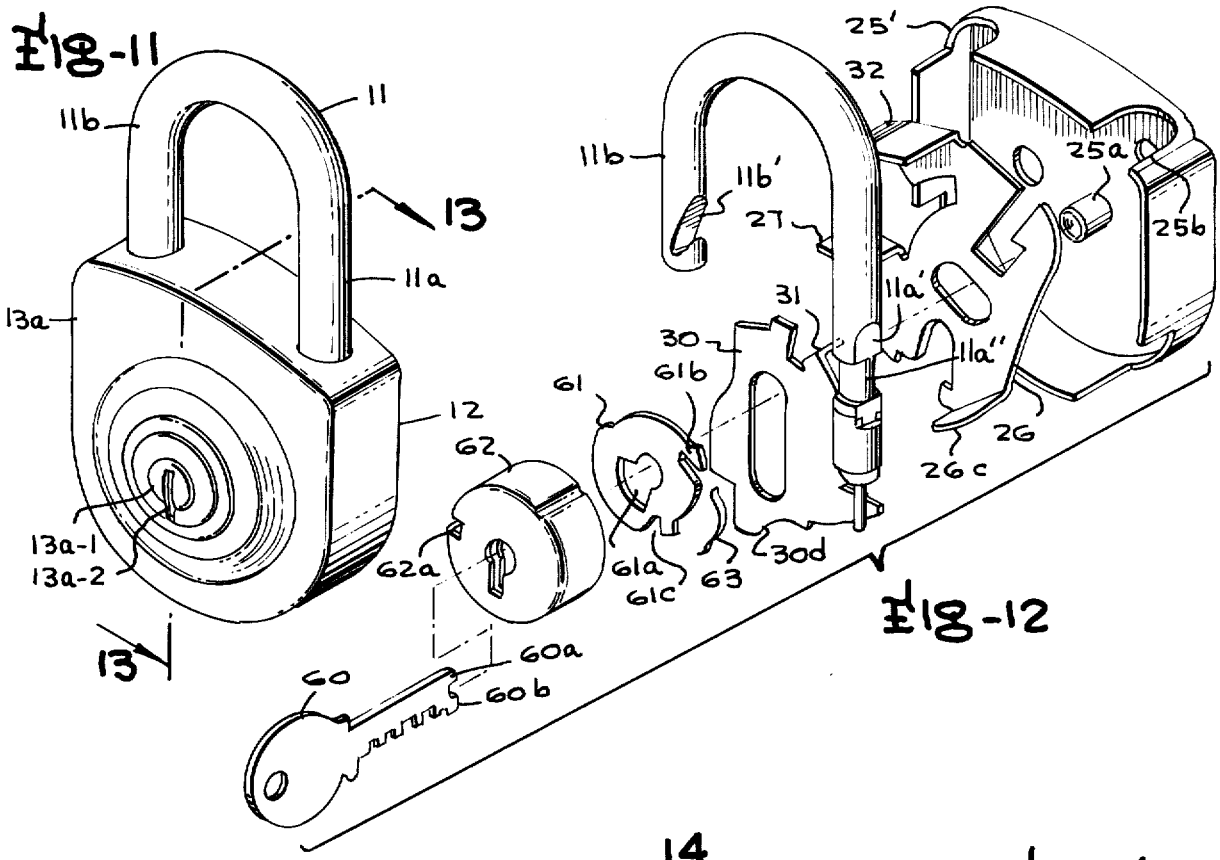
Fig-11
11
11b
13
11a
13a
12
13a-1
13a-2
13
Fig-12
25'
32
11b
11b'
25a
25b
27
11a'
31
30
11a''
61
61b
62
26
26c
62a
61a
61c
63
30d
60a
60
60b
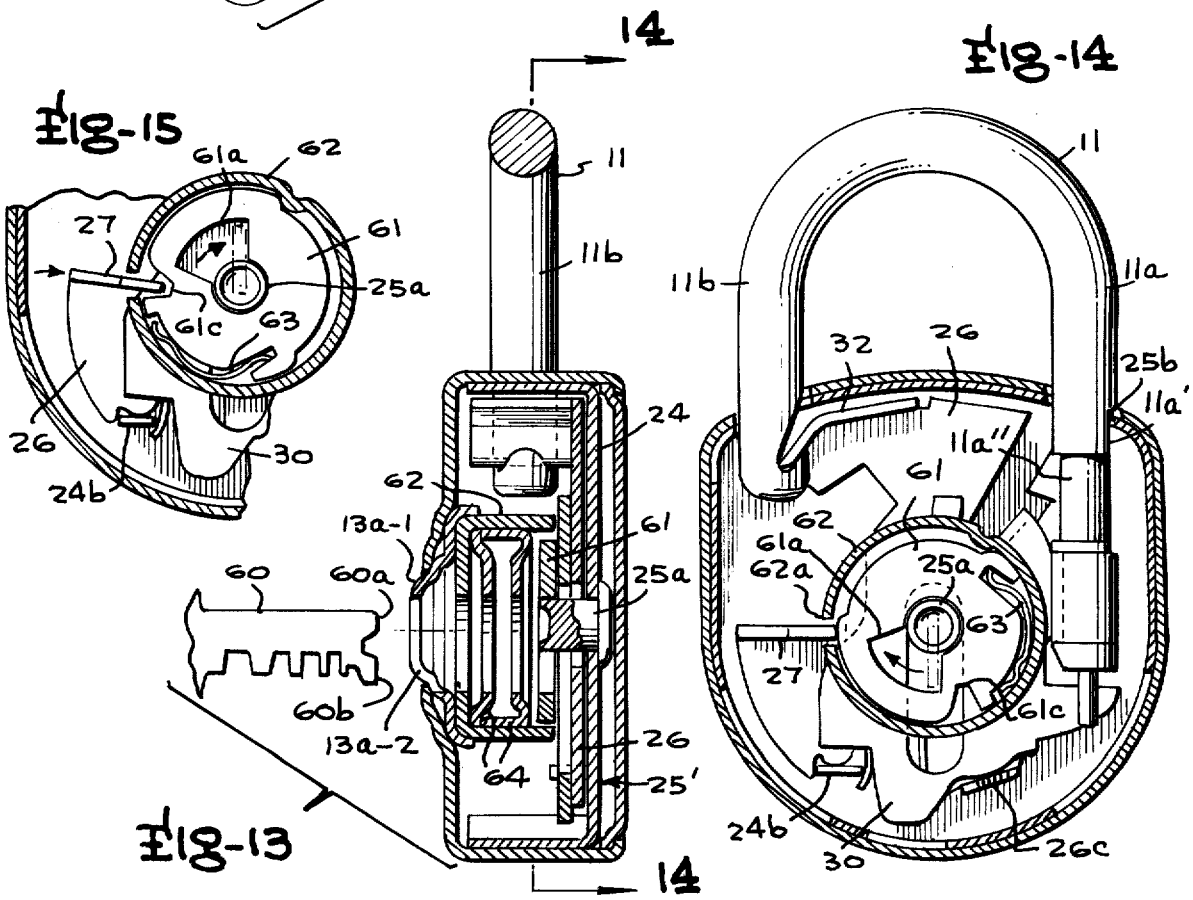
Fig-15
61a
62
27
61
25a
61c
63
26
30
24b
14
Fig-14
11
11b
11a
32
26
25b
11a'
11a''
61
62
61a
62a
25a
63
27
61c
24b
30
26c
24
62
13a-1
61
60
60a
25a
60b
13a-2
26
64
25'
Fig-13
14

EXPOSED SHACKLE PADLOCK

BACKGROUND AND OBJECTS OF THE INVENTION

The present invention relates in general to padlocks, and more particularly to combination padlocks of the exposed shackle type having rotatable tumbler elements to be rotatably adjusted by the owner to a predetermined combination of angular positions by rotation of some external mechanism, thereby releasing the internal locking mechanism from the shackle so that the shackle can be retracted through a sufficient stroke outwardly of the padlock body to attain an unlocking position.

Heretofore, many types of combination padlock mechanisms have been devised, wherein rotation of a dial and dial knob assembly through a selected combination of turns in alternating opposite directions to different predetermined angular positions conditions a locking mechanism within the padlock casing or body to release a locking shoulder or dog from the shackle. This permits the shackle to be shifted through a selected stroke outwardly of the padlock casing until a shorter leg of the shackle is completely withdrawn from the lock casing whereupon the shackle can be swung about the axis of the longer leg still held in the padlock casing to shift the shackle to an open position. One of the typical types of internal locking mechanisms employed in such exposed shackle combination padlocks is to provide a plurality of tumbler wheels rotatably journaled on a common axis or post and having some sort of lost motion coupling between the successive tumbler wheels to achieve successive positioning of a peripheral gate in each of the tumbler wheels at a preselected position permitting a sufficient range of movement of a locking device to achieve retraction of the locking mechanism from interlocking relation with the shackle. However, these prior combination padlocks have usually been of rather expensive construction, frequently employing many cast parts and expensive cast padlock bodies or casings, if the locks are constructed in such manner as to provide reasonable protection against accidental operation by impact forces resulting from dropping of the lock or hitting of the lock against another object, and if the construction of the lock is such as to provide reasonably long reliable operational life under heavy use as encountered on school lockers, and similar applications.

An object of the present invention is the provision of a novel exposed shackle padlock construction wherein most of the padlock components are formed from stamped or shaped sheet metal parts and wherein the manner of manufacture and construction of the lock achieves considerably economies in the manufacture of a padlock of reliable and yet inexpensive construction. Another object of the present invention is the provision of a novel exposed shackle combination padlock construction of the type described in the immediately preceding paragraph, which is highly resistant to accidental unlocking operation of the padlock, and wherein the set of tumbler wheels can be readily set during manufacture to a number of different positions relative to the dial knob to easily establish a large number of different combinations for the padlock.

Another object of the present invention is the provision of a novel exposed shackle combination padlock construction having a key override feature facilitating opening of the combination padlock by a master key under the control of a custodian or the like to enable unlocking of the padlock when the combination has been forgotten or the owner of the padlock is not available to operate the padlock.

Yet another object of the present invention is the provision of a novel exposed shackle padlock construction having an operating mechanism similar to that of the above described combination padlocks but which is operable by a ward key rather than by manipulation of a dial and knob assembly to effect release of the padlock shackle.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 11 is a front perspective view of a key operated version of the exposed shackle padlock;

FIG. 12 is an exploded perspective view of the principal components of the locking mechanism for the key operated padlock;

FIG. 13 is a vertical section view taken along the line 13—13 of FIG. 11;

FIG. 14 is a vertical section view taken along the line of 14—14 of FIG. 13; and FIG. 15 is a fragmentary section view similar to FIG. 14 but showing the bolt cam in unlocking position with the fence positioned in the gate thereof.

DETAILED DESCRIPTION OF PREFERRED EMBODIMENTS

Figure 2:
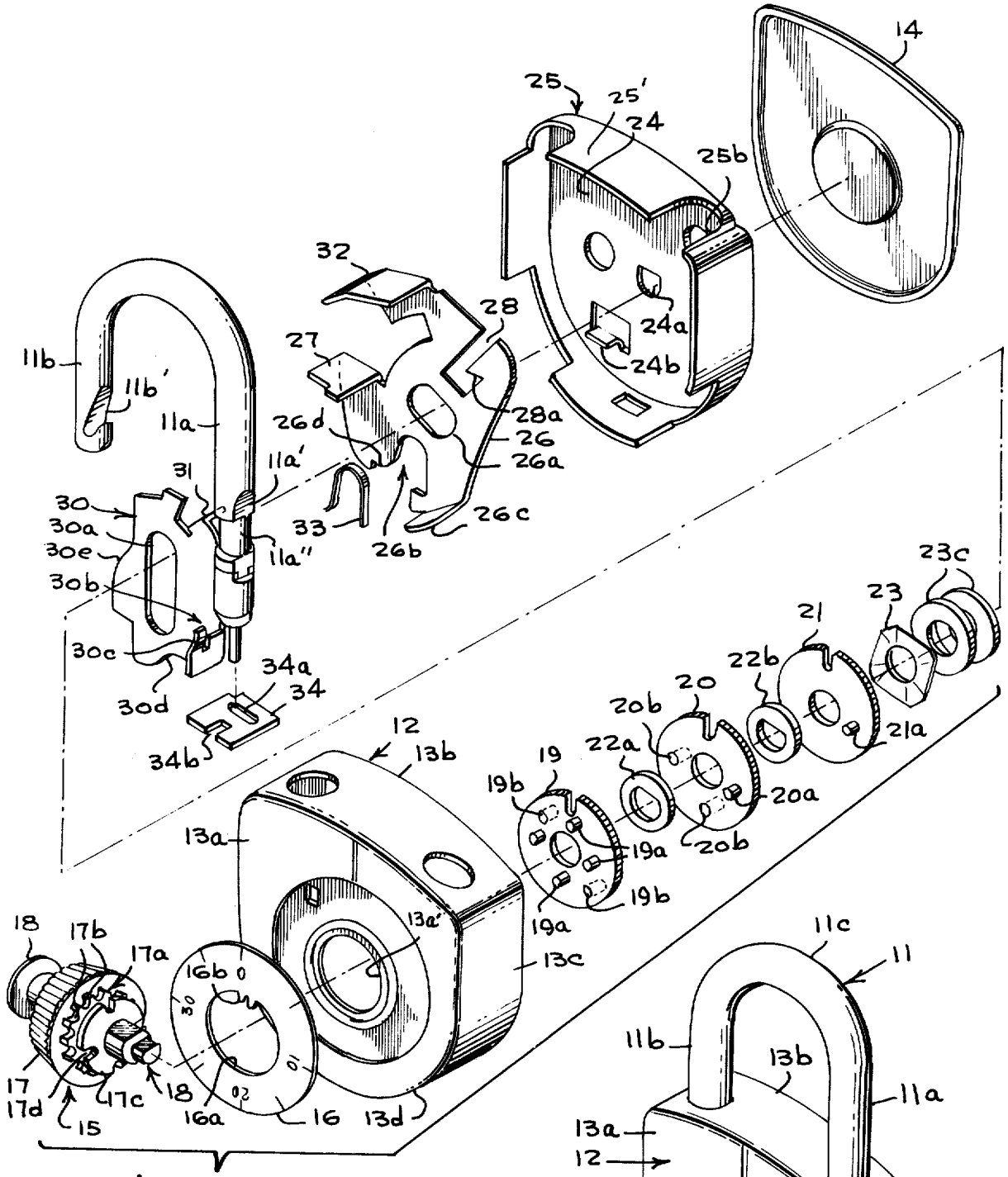
FIG. 2 is an exploded perspective view of the combination padlock.
Figure 1:
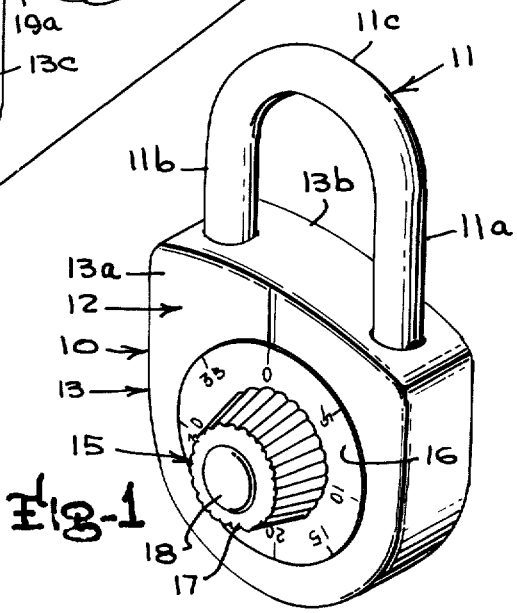
FIG. 1 is a front perspective view of an exposed shackle padlock embodying the present invention.
Figure 3:
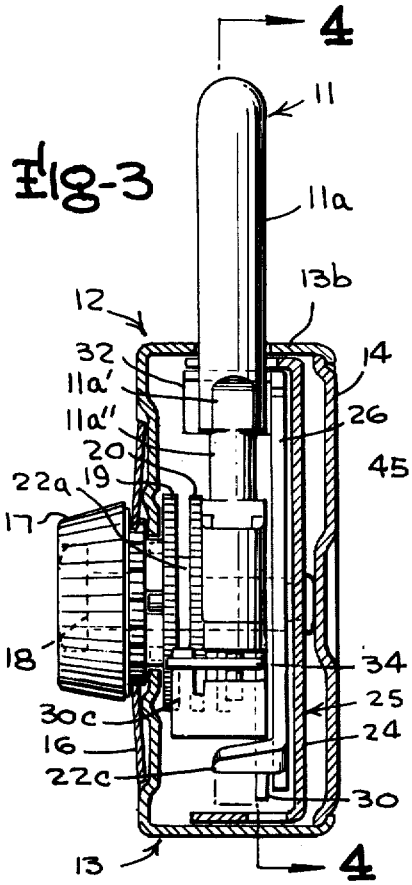
FIG. 3 is a side elevation view of the padlock with parts of the padlock casing broken away.

Referring to the drawings, wherein like reference characters designate corresponding parts throughout the several Figures, and particular to the first embodiment of the exposed shackle combination padlock illustrated in FIGS. 1 to 7 of the drawings, there is shown an exposed shackle combination padlock, generally indicated by the reference character 10, having a conventional U-shaped shackle 11 formed of a longer leg 11*a*, a shorter leg 11*b*, and a curved or bight portion 11*c*, which projects from the top portion of the padlock casing or body 12. In the illustrated embodiment, the padlock casing 12 is formed of a rearwardly opening casing shell, formed for example from sheet metal, defining a front wall 13*a*, a top wall 13*b* having two apertures therein for receiving the shackle legs, and sidewalls 13*c* merging into a curved bottom wall 13*d*, all forming the rearwardly opening front casing shell 13. A rear cover member 14 forms the rear wall of the casing, fitting into the flange like walls defined by the front, top and bottom walls 13*a*–13*c* to provide an enclosure for the locking mechanism.

A dial knob and dial assembly 15 is disposed in forwardly exposed relation overlying the front wall 13*a* and comprises an annular dial member 16, as best shown in FIG. 2, having dial markings, for example forty graduations, on the front surface thereof adjacent the circular periphery and appropriate numbers, for example for every five graduations, and includes a center opening 16*a* of circular configuration interrupted by two circumferentially spaced teeth 16*b* extending into the center opening. The dial member 17 is of generally truncated conical configuration having knurled formations or ridges along its perimeter of conventional construction, and having a rearwardly projecting hub portions 17*a* of a maximum diameter corresponding to the diameter of the center opening 16*a* of the dial 16 and provided with a plurality of notches or recesses 17*b* circumferentially spaced about the circumference of the hub providing tooth-like formations to receive the two teeth 16*b* of the dial 16 in interfitted or intermeshed relation therewith. In one example, twenty of such teeth or recesses 17*b* may be provided in the hub of the knob 16, permitting the annular dial 16 to be assembled on the hub portion of the knob 17 at any of twenty different annular positions relative to the knob. A smaller diameter second hub formation 17*c* projects rearwardly from the intermediate hub formation 17*a* to extend through and journal the dial knob assembly in the circular opening 13*a*′ in the front wall 13*a* of the padlock casing.

The second rearmost hub formation 17*c* has, in the illustrated embodiment, four circumferentially spaced peripheral recesses 17*d* therein, spaced approximately 90° apart or in quadrant relation, and has a central circular cavity in which is seated the forwardmost end portion of a dial knob spindle 18 which projects rearwardly through the major portion of the mechanism chamber defined by the lock casing. The four rearwardly opening peripheral recesses 17*d* are provided to receive four forwardly projecting drive pins or lugs 19*a* extending forwardly from the number 1 or forwardmost peripherally gated tumbler wheel 19 having a center opening and journaled on the spindle 18. In the illustrated embodiment, a stack or pack of three peripherally gated tumbler wheels are provided, with intervening washers, the number 2 and number 3, successively rearwardly spaced, tumbler wheels 20 and 21 having washers 22*a* and 22*b* spaced between them and their adjacent tumbler wheels. A deformed annular spring 23 and one or a pair of washers 23*c* are disposed on the spindle 18 rearwardly abutting the rearmost or number 3 tumbler wheel 21 and the pack of tumbler wheels and washers is held in assembled relation on the spindle 18 by abutment of the rearmost washers 23*c* against an actuator plate on the shackle and a fence plate, later described, forwardly overlying the rear wall 24 of a mechanism carrier frame 25 located within the lock casing. A constricted rear end portion of the spindle 18, of nonround cross-section, extends through a corresponding configured nonround opening 24*a* in the carrier frame wall 24 and is peened over against he rearmost surface of the wall 24 to assembly the spindle 18 therein. The spindle 18 over the portion thereof accommodating the tumbler wheels and the washers 22*a* and *b* is also of nonround cross-section, for example by providing a flat along a portion thereof as illustrated in FIG. 2, and the center openings of the washers 22*a* and 22*b* are of corresponding nonround configuration so that the washers do not rotate with the tumbler wheels.

The number 1 or forwardmost tumbler 19 in the illustrated embodiment has a pair of rearwardly projecting drive pins 19*b*, located a proper radial distance from the axis of rotation of the tumblers to be disposed just outwardly of the associated washer and to intercept the forwardly projecting driving pin 20*a* of the number 2 tumbler 20 to affect a lost motion drive between the tumbler 19 and the tumbler 20. Similarly, a pair of drive pins 20*b* extend rearwardly from the number 2 tumbler wheel 20 to rotate in a path just outwardly of the perimeter of the washer 22*b* and intercept a forwardly projecting drive pin 21*a* on the rearmost tumbler 21 to achieve a lost motion drive of the rearmost tumbler 21 from the tumbler wheel 20.

Figure 4:
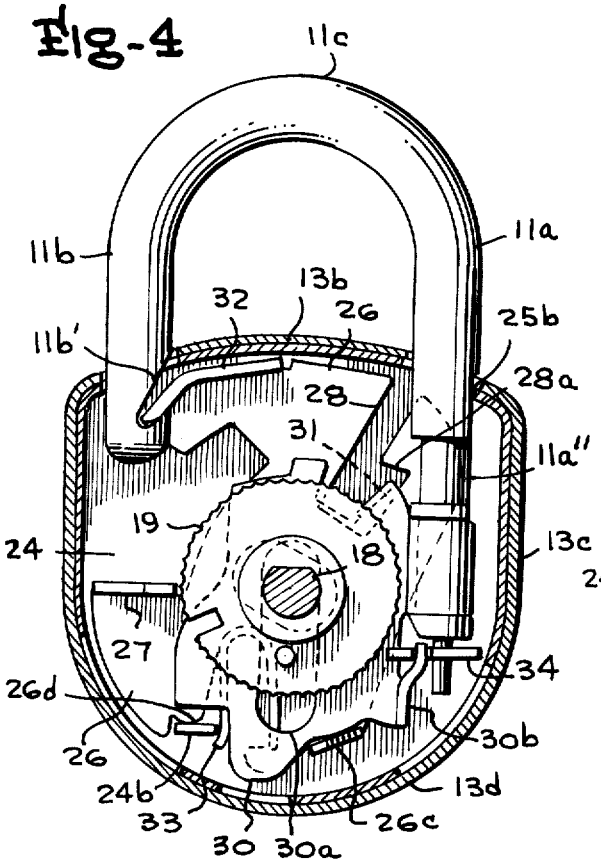
FIG. 4 is a vertical section view, taken along the line 4—4 of FIG. 3 showing the padlock in locked condition.

A fence plate 26 having a fence 27 projecting forwardly from the left center portion thereof as illustrated in FIG. 4 (at about the 9:00 o'clock position) is supported for pivotal movement about an axis adjacent the lower region of the fence plate on the forwardly projecting lug 24*b* on the rear wall 24 of the carrier frame 25, so that the edge of the fence 27 confronting the peripheries of the tumblers 19, 20 and 21 is normally located just outwardly of the peripheries of the tumbler wheels when the shackle is in the fully locked position. An inclined slot 28 opens through the upper edge of the fence plate 26 and has an enlarged portion spaced inwardly of the upper edge defining a restraining shoulder 28*a*. An actuator plate 30 is journaled on the lower end portion of the longer leg 11*a* of the shackle 11 and has a rearwardly projecting lug formation 31 thereon extending into the slot 28 and normally locked behind or below the shoulder 28*a* of the inclined slot when the shackle is in the fully locked or down position. Also, the forwardly projecting locking flange 32 on the fence plate 26 extending forwardly from the upper edge thereof interfits into a notch in the shorter shackle leg 11*b* near the free end of the shorter shackle leg when the fence plate 26 is in the locking position illustrated in FIG. 4, whereby the locking flange 32 interfitted in the notch 11*b*′ of the shorter leg and the lug formation 31 of the actuator plate 30 interfitted in the slot 28 below and against the restraining shoulder 28*a* provide double blocking points for restraining the shackle in locked position.

An inclined center slot 26*a* is provided in the fence plate 26 to accommodate the dial spindle 18 projecting therethrough and permit arcuate or pivotal movement of the fence plate through an appropriate range about the pivot axis defined by the lug 24*b* of the carrier frame 25, and the actuator plate 30 journaled to the longer leg 11*a* of the shackle is also provided with an elongated slot 30*a* to accommodate the rearwardly projecting portion of the dial spindle 18 and permit the appropriate range of vertical movement of the actuator plate 30 upon movement of the shackle 11 between the downwardmost or locked position to the uppermost or released position.

A slot 26*b* opens through the bottom edge of the fence plate 26 and is shaped both to accommodate a U-shaped spring 33 having a right hand leg which bears against the right hand edge of the slot 26*b* as illustrated in FIG. 4 and a left hand leg whose lower portion bears against the lug 24*b* so as to bias the lower right hand portion of the fence plate 26 as viewed in FIG. 4 to the right, the lower portion of the slot 26*b* accommodating the pivot defining lug 24*b* and accommodating relative movement of the lug 24*b* to the right within the slot to accommodate return movement of the shackle inwardly from the release position to the locked position as later described.

Means are provided for automatically scrambling the tumbler wheels during the retraction movement of the shackle outwardly of the padlock casing from the locked to the release position, so that the tumbler wheels do not stand in the unlocking position while the shackle is in the outermost or released position. To accomplish this, the peripheries of the tumbler wheels 19, 20 and 21 are provided with serrations or peripherially spaced shallow recesses, and a scrambler plate 34 is provided on the lower portion of the longer shackle leg 11*a*. The scrambler plate 34 has a central aperture 34*a* through which is received the constricted lower end portion of the longer shackle leg 11*a*, and the scrambler plate is loosely held in position by locating the place in the recess 30*b* of the actuator plate 30 with the slot 34*b* in the edge of the scrambler plate receiving the extension lug 30*c*. The scrambler plate 34*a* is therefore carried upwardly alongside peripheries of the tumbler wheels 19, 20 and 21 as the actuator plate 30 and the lower end portion of the longer shackle leg 11*a* move upwardly during retraction of the shackle from the lowermost locked position to the uppermost release position, the edge of the scrambler plate 34 confronting the tumbler wheels thereby contacting the tumbler wheels by engaging the serrated or recessed portions thereof, when the scrambler plate reaches the FIG. 6 position, and causing them to turn from the position wherein the gates were aligned to receive the fence 27 to a misaligned position as shown in FIG. 7 when the shackle reaches fully retracted position.

Figure 5:
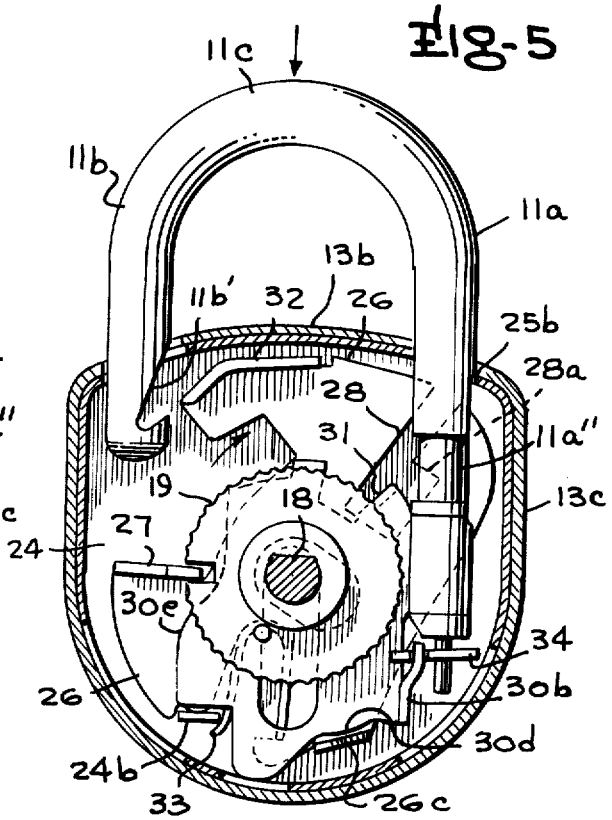
FIG. 5 is a section view taken from the same position as FIG. 4, with the shackle pushed down to rock the fence plate to release position.
Figure 6:
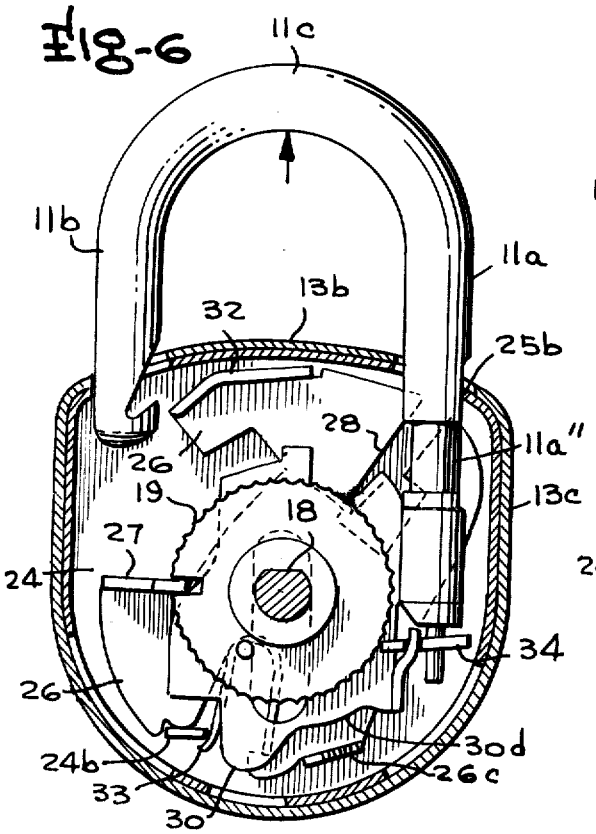
FIG. 6 is a section view from the same position as FIG. 4, showing the shackle in an intermediate position during opening movement thereof.

In the operation of the combination padlock, the operator dials the three numbers of the combination by rotation of the dial knob 17 first in a clockwise position to the first number, then through a partial revolution in a counterclockwise direction to the second number through a selected range of rotation, and thence in a clockwise direction to the third number of the combination. During these manipulations of the dial knob 17, the inter-engagement of the drive pins on the various tumbler wheels successively adjusts first the rearmost tumbler 21, then the intermediate tumbler 20, and then the forwardmost tumbler wheel 19 to the proper angular position to dispose their peripherial gates so as to face toward and be aligned with the fence 27. Upon thus setting the tumbler wheels to the proper positions, the operator can then grasp and push inwardly upon the shackle, engaging the edge portion 30*d* of the actuator plate 30 against the lug or shoulder 26*c* on the fence plate 26 and forcing the fence plate 26 to rock about the pivot axis defined by the nose 26*d* bearing on the lug 24*b* to the right from the FIG. 4 to the FIG. 5 position to release the locking flange 32 from the shackle notch 11*b'* and free the shackle to be pulled outwardly for withdrawal fully to the release or outermost open position. The fact that the shackle 11 must be pushed downward to achieve unlocking, together with the arrangement of the fence plate so that the locking flange 32 must move in an arc away from the shackle permits use of a deep tapered notch 11*b'* in the shackle for great locking strength and resistance to lateral slipping of the locking flange out of the notch when pressure is applied to the shackle. This rocking movement of the fence plate 26 also withdraws the restraining shoulder 28*a* out of restraining position relative to the lug formation 31, as shown in FIG. 5 thus permitting free retraction of the shackle. It will be noted that during the opening movement of the shackle, the fence plate 26 will have been returned to the normal locking position as the free end of the shorter shackle leg passed through the opening in the padlock casing, due to the engagement of the cam surface 30*e* of plate 30 with the fence 27 as the shackle rises toward open position. As previously stated, during this outward movement of the shackle, the concurrent movement of the scrambler plate 34 with the lowermost portion of the longer shackle leg 11*a* brings an edge of the scrambler plate 34 into engagement with the peripheries of the tumbler wheels 19, 20 and 21, as shown in FIG. 6, to rotate the tumbler wheels out of their set position and thus displace them from the position wherein their gates were aligned to receive the fence and permit opening movement of the shackle. The stationary lip 25*b* of the carrier frame top wall 25' located in the recess 11*a'* in the longer shackle leg keeps the shackle from being rotated about the axis of the leg 11*a* until the shackle is almost fully retracted to the FIG. 7 position, when the circumferential extension groove 11*a''* of recess 11*a'* reaches the level of lip 25*b* to accommodate the lip during rotation of the shackle. Because the lip 25*b* and recess 11*a'*, the shackle is also prevented from being returned inwardly of the case to locked position without first rotating the shackle back to align the shorter leg 11*b* with its shackle hole in the case, as the edge of the lip 25*b* aligns with the flat wall of the recess 11*b'* only at that shackle position.

Figure 7:
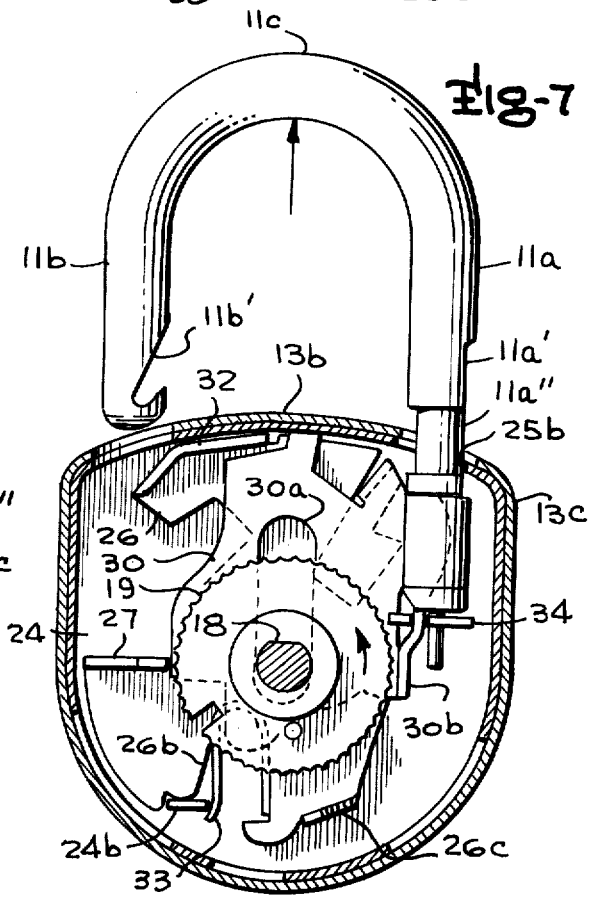
FIG. 7 is a section view from the same position as FIG. 4, showing the shackle fully withdrawn to release or open position.

When it is desired to return the shackle from the fully retracted release or open position of FIG. 7, to innermost or locked position, the shorter shackle leg 11*b* is aligned with the aperture therefor in the top wall of the padlock casing, and the shackle is forced inwardly along the translation axis defined by the axis of the longer shackle leg, whereupon the lower end of the shorter shackle leg engages the locking flange 32 on the fence plate 26 during this inward movement of the shackle. Upon pushing downwardly on the shackle to return it to locking position, the free end portion of the shorter shackle leg engages the upper surface of the locking flange 32, the inclined relationship of the locking flange surface causes the fence plate 26 to rock about an axis near the center of the plate 26, defined by engagement of the edge of the fence 27 with the peripheries of the now misaligned tumbler wheels 19, 20 and 21, together with the spindle 18 extending through the opening 26*a*. The lower end portion of the plate 26 is allowed to swing to the right enough to allow the end of the shackle leg 11*b* to pass downwardly by the fence 27, as the spring 33 compresses in the slot 26*b* and accommodates a limited amount of relative movement of the lug 24*b*, and the compressed spring then promptly rocks the fence plate 26 back to the locking position when the locking flange 32 registers with the shackle notch 11*b'* to seat the flange 32 in the notch 11*b'*.

Figure 8:
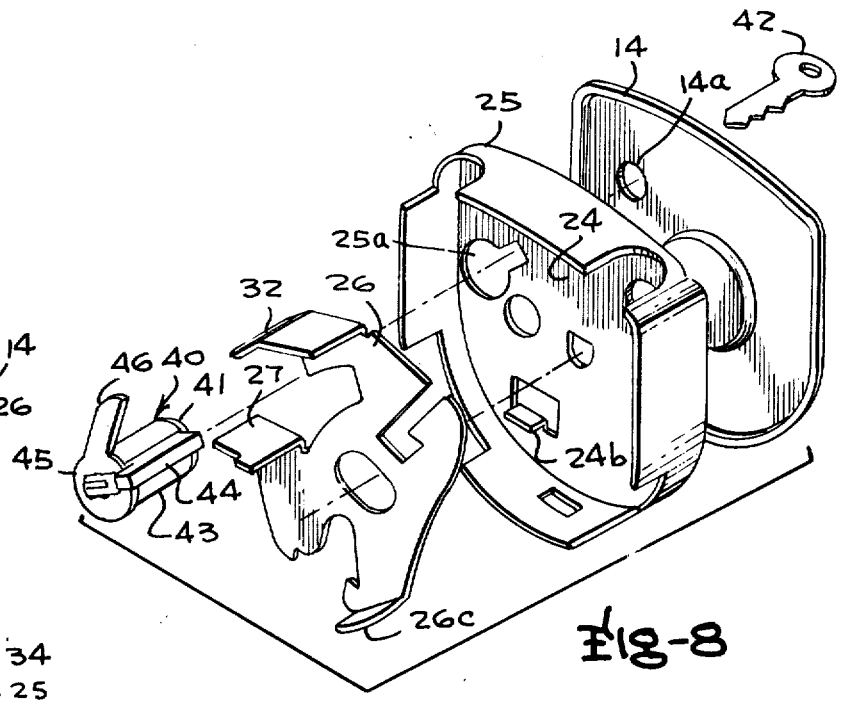
FIG. 8 is a fragmentary exploded perspective view showing significant components incorporated in the combination padlock to provide a key override feature.
Figure 9:
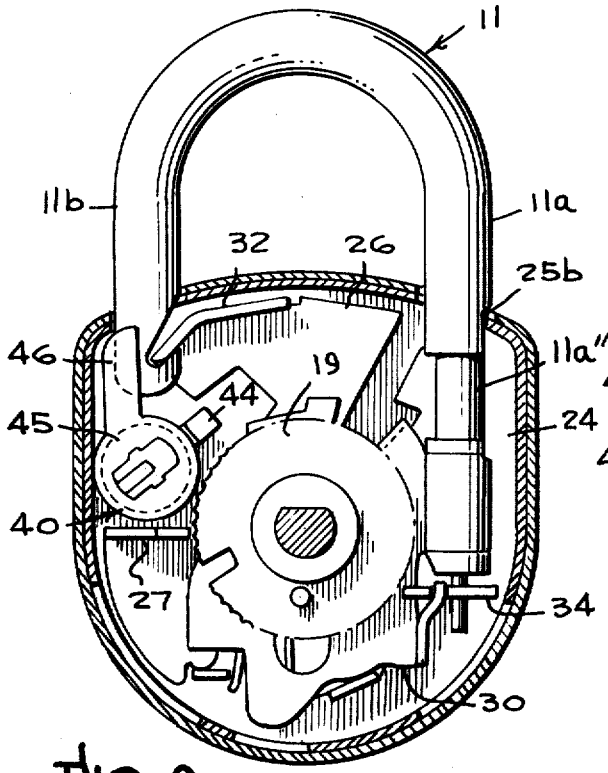
FIG. 9 is a vertical section view of the padlock with the key override feature, taken from a position similar to FIG. 4, with the padlock in locked condition.
Figure 10:
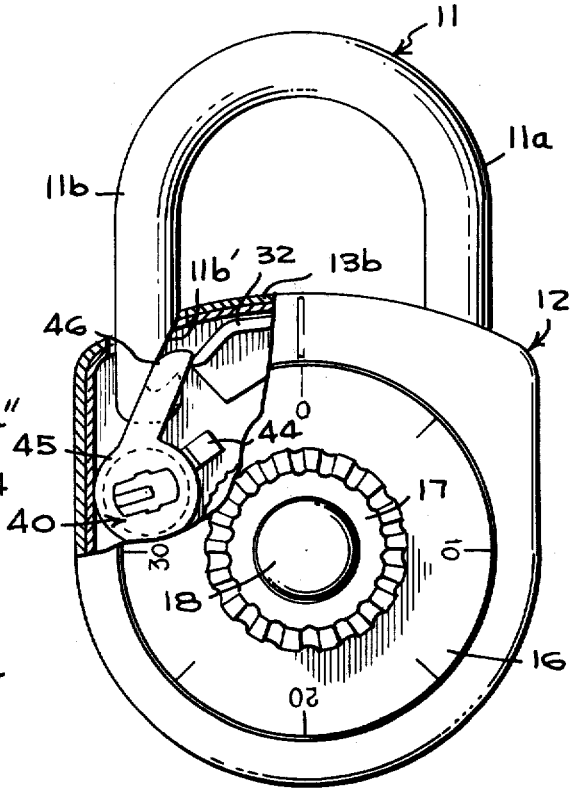
FIG. 10 is a front elevation view of the combination padlock with key override feature, with part of the front wall and dial broken away, showing the key lock bolt in shackle releasing position.

It will be appreciated that in cases where the combination padlock is to be used to secure lockers in a school facility, or in a locker room of a gymnasium, club or the like, it is desirable in such cases that the custodian have the ability to unlock the padlocks on any of the lockers so as to either gain access to the locker or to remove the padlock from the locker, where, for example, the person to whom the lock is assigned has forgotten the combination, or is otherwise unavailable to operate the padlock. The exposed shackle combination padlock previously described herein, of the general construction illustrated in FIGS. 1 through 7, can be conveniently and inexpensively provided with a key override feature whereby the custodian can achieve release of the shackle for unlocking of the lock by use of a master key. Referring to FIGS. 8, 9 and 10, wherein components corresponding to those described in connection with the first embodiment of FIGS. 1 to 7 are indicated by the same reference characters, it will be understood that the padlock includes the same shackle 11 and substantially the same padlock casing 12 enclosing the same basic combination padlock components described in connection with the preceding embodiment. The combination padlock mechanism of this key override type combination padlock includes the dial knob 17 and dial member 16 of the preceding embodiment, as well as the same three tumbler wheels, only tumbler wheel 19 being illustrated in FIG. 9, as well as the same fence plate 26, carrier frame 25, actuator plate 30, and the other components described in connection with the preceding embodiment. It will be noted from FIG. 8, however, that the rear wall 24 of the carrier plate 25 is additionally provided with a shaped aperture 25*a* in the upper left hand portion thereof as viewed in FIG. 8 providing a circular aperture portion and a rectangular extension therefrom conforming to the cross-sectional configuration of the casing 43 of a cylinder type key lock 40 so as to position the cylinder lock 40 a short distance below the free end of the short shackle 11*b* when the latter is in locked position. The rear cover member 14 of the padlock casing is also provided with a circular aperture 14*a* for receiving and journaling the key entry end portion of the rotatable plug 41 of the cylinder lock for introduction of the master key 42 into the key way to operate the cylinder lock.

The cylinder type key lock 40 is of conventional rotatable plug, pin tumbler construction, and includes the outer cylinder lock casing 43 having the radially outwardly projecting pin tumbler housing 44 which is fitted into the correspondingly sized and shaped extension of the shaped aperture 25*a* so as to hold the casing 43 of the cylinder lock against rotation. The forward end portion of the rotatable plug of the cylinder lock 40 is of conventional nonround configuration and has fitted thereon a bolt member 45 having an extension or actuating finger 46 which normally extends vertically upward alongside the left wall of the padlock casing 12, as shown in FIG. 9, when the cylinder lock is in the locked position, disposing the finger 46 between that left wall and the edge of the locking flange 32 in the shackle notch 11*b'* during normal combination lock operation of the padlock. However, when the custodian having the master key 42 desires to open the padlock without knowledge of the combination, he inserts the key 42 into the rotatable plug 41 of the override key lock 40 and manipulates the key to rotate the bolt 45 in a clockwise direction as viewed in FIGS. 9 and 10 to the FIG. 10 position. This rotation of the bolt 45 brings the straight edge of the bolt finger 46 into engagement with the edge of the locking flange 32 which normally lies in the locking notch 11*b'* of the shackle, and rocks the fence plate 26 in a clockwise direction as viewed in FIGS. 9 and 10 to force the locking flange portion 32 of the fence plate to the release position of FIG. 10 withdrawing it from the shackle notch so that the shackle can be withdrawn outwardly of the casing to the open position. When it is desired to relock the padlock, the key lock is merely returned to the normal ormal or locked position, and the shackle 11 is forced inwardly toward the casing to return the short shackle leg 11*b* into its opening in the casing, camming the fence plate counterclockwise by the interaction of the free end of the short shackle leg against the inclined surface of the locking flange 32 until the locking flange returns into seated relation in the shackle notch 11*b'*, in the same manner as with the previously described embodiment.

FIGS. 11 to 15 inclusive disclose a modification of the exposed shackle padlock wherein the same basic case, shackle, carrier frame, fence plate and actuator plate components are employed as in the previously described embodiments, but which is modified to provide for operation of the fence plate to release and lock the shackle responsive to a key of the flat key type. As illustrated in FIG. 11, the shackle 11 is of the same U-shaped configuration as in the previously described embodiments having a longer leg 11*a* and a shorter leg 11*b* extending from the padlock body 12 which, in this embodiment, has a rotatable key barrel 13*a*-1 journaled in a center aperture in the front wall 13*a* of the padlock case, with the key barrel having a keyway or key slot therein and the portion of the front casing wall 13*a* immediately below and vertically aligned therewith also having a slot portion therein. Within the padlock body 12 is a carrier frame 25' similar to the carrier frame of the previously described embodiment, but having a center aperture therein in which is located a boss or post 25*a* having a forwardly opening socket in the front end thereof to receive and form a journal for the rounded nose portion 60*a* of the key 60 when the key is fully inserted in the keyway 13*a*-2 in the front wall of the casing. Immediately forwardly of the rear wall 24 of the carrier frame 25' is the fence plate 26 which is of the same configuration as the fence plate in the previously described embodiment, having the fence 27 thereon and the forwardly projecting locking flange 32 normally seated in the locking notch 11*b'* of the shorter shackle leg 11*b*. The fence plate 26 rocks on the forwardly extending lug 24*b* in the same manner as in the previously described embodiment, and is biased by a spring like the spring 33 of the previous embodiment. The longer shackle leg 11*a* also carries the actuator plates 30 of the same configuration as the actuator plate of the previously described embodiment operating in the same manner, except that the actuator plate does not have the forwardly extending portion 30*b* and does not carry a scrambler plate 34 since there are no tumbler wheels in the key operated embodiment.

Rotatably journaled on the forwardmost portion of the boss 25*a* is a key operated rotable bolt cam 61 having an arcuate recess 61*a* therein to receive the forwardly projecting excentric formation 60*b* on the end of the key so that rotation of the key 60 through a selected arc, in this case an arc of 180°, from the position shown in FIG. 12, effects approximately 90° rotation of the bolt cam 61. The bolt cam 61 also fits within the rearmost portion of the ward housing cup 62 and is frictionally restrained at whatever angular position of adjustment it may be shifted to by the spring 63 extending into the peripheral notch 61*b* in the bolt cam and bearing against the inner surface of the cylindrical wall of the ward housing cup 62. The bolt cam 61 also has a peripheral gate 61*c* which is normally positioned approximately 90° in a counterclockwise direction from the fence 27 but which is shifted by the key 60 upon rotation of the key through the proper angular range, for example 180°, to align the gate laterally with the fence to receive the fence and thus permit the rocking movement of the fence plate 26 responsive to downward and then upward movement of the shackle in the same manner as rocking of the fence plate is achieved in the previously described embodiments to release the locking flange 32 from the shackle notch 11*b'* and permit movement of the shackle to the opening position. The cylindrical wall portion of the ward housing cup 62 also has a laterally opening slot 62*a* therein accommodating the edge portion of the fence 27 immediately adjacent to the periphery of the bolt cam 61 as is illustrated in FIG. 14. The front circular wall of the ward housing cup 62 is also slotted to receive the key, as is shown in FIG. 12, and between the front wall of the ward housing cup and the bolt cam are a plurality of ward members 64 of conventional construction having key receiving arcuate recesses therein of appropriate size and dimensions to provide barriers against rotation of keys other than a key with the properly shaped edge, from the vertical position illustrated in FIG. 12 to the position necessary to align the gate of the bolt cam with the fence. It will be appreciated that upon insertion of the proper key 60 into the keyway 13*a*-2 and the key slots provided in the front wall of the ward housing cup 62 and the ward members 64 and bolt cam 61, the key can be rotated clockwise through approximately 180° from the position illustrated in FIG. 12 to rotate the bolt cam 61 from the normal locking position illustrated in FIG. 14 to the unlocking position of FIG. 15 aligning the gate 61*c* with the fence 27 to permit the rocking movement of the fence plate 26 required to release and open the shackle 11. The key can then be returned to the vertical position illustrated in FIGS. 12 and 14 and withdrawn from the padlock casing, and thereafter the shackle can be returned to locking position in the same manner as in the previously described combination padlock embodiment.

What is claimed is:

1. An exposed shackle padlock comprising a casing having shackle openings in a top wall thereof for reception of shackle legs, a shackle movable relative to the casing between inner locking and outer release positions having legs extending through said openings including a longer leg supported for axial and rotary movement within the casing and a shorter leg having a latching notch, means defining a stationary pivot in a lower region in the casing, a fence plate having a fence flange and a locking flange integrally formed thereon supported for rocking movement between latching and unlatching positions about a first pivot axis adjacent the pivot and having a slot shaped to accommodate lateral translatory relative movement of the pivot in the slot, said locking flange projecting into locking relation in said latching notch at the inner locking position of the shackle when the fence plate is in latching position, rotatable locking means in said casing including a peripherally gated rotatable tumbler wheel member normally occupying a locking position wherein peripheral portions thereof adjacent said fence flange prevent fence plate movement from said latching position and operable from externally of the casing to occupy an unlocking position disposing its gate to receive the fence flange and accommodate rocking of the fence plate to unlatching position, means operable when the locking means is in said unlocking position for moving the fence plate to unlatching position responsive to initial inward force on the shackle causing inward shackle travel followed by outward withdrawing force on the shackle causing outward shackle travel including an actuator plate coupled to and movable with said longer shackle leg located within the casing in adjacent parallelism with the fence plate having a lug projecting therefrom, the fence plate having a shouldered slot therein receiving said lug shaped to dispose the shoulder portion of the slot in adjacent overlying relation to the lug when the fence plate occupies the latching position to intercept the lug and prevent movement toward release position of the actuator plate and interconnected shackle, the shouldered slot having a passage shaped and located when the fence plate is in unlatching position to accommodate travel of the lug during shackle releasing movement of the actuator plate responsive to said outward withdrawing force on the shackle, means for initially rocking said fence plate about said pivot from latching to unlatching position responsive to application of said initial inward force on the shackle when the locking means is in said unlocking position to withdraw the locking flange from the latching notch and shift said shouldered portion of the shouldered slot out of intercepting relation to said lug, said fence plate remaining in unlatching position during an initial portion of said outward shackle travel until the latching notch is disposed outwardly beyond the locking flange and said actuator plate having a cam surface formation for engaging the fence plate and returning it to said latching position during a second portion of outward shackle travel following said initial portion, the end of said shorter shackle leg and said locking flange being shaped for rocking the fence plate toward unlatching position to admit the shackle to said inner locking position during inward travel of the shackle, and spring means for returning the locking flange into locking relation in said latching notch when the shackle reaches said inner locking position following said inward travel.

2. An exposed shackle padlock as defined in claim 1, wherein said slot in said fence plate and said lug on said actuator plate are located closely adjacent to said longer shackle leg on the opposite side of a vertical center plane through the casing relative to said latching notch and the portion of said fence flange seated therein in the latching position of the fence plate.

3. An exposed shackle padlock as defined in claim 1, wherein said passage portion of said slot in the fence plate is inclined in upwardly converging angular relation to the axis of said longer shackle leg for accommodating relative upward movement of the actuator plate lug as the fence plate returns to latching position during outward shackle and actuator plate movement toward said release position of the shackle.

4. An exposed shackle padlock as defined in claim 2, wherein said passage portion of said slot in the fence plate is inclined in upwardly converging angular relation to the axis of said longer shackle leg for accommodating relative upward movement of the actuator plate lug as the fence plate returns to latching position during outward shackle and actuator plate movement toward said release position of the shackle.

5. An exposed shackle padlock as defined in claim 3, wherein said locking flange of said fence plate is located immediately below said top wall having said shackle openings therein and includes an inclined flange lip portion in underlapping alinement with the shackle opening for the shorter shackle leg, said flange lip portion extending in downwardly and outwardly declining relation to the extended axis of the shorter shackle leg when said shorter leg is in release position outwardly of the top wall and alined with its opening to be cammed by the free end of the shorter leg upon inward return movement of the shackle toward locking position and effect rocking of the fence plate about an axis different from said first pivot axis adequate to permit passage of the shorter shackle leg to said locking position alining the latching notch to receive the fence flange.

6. An exposed shackle padlock as defined in claim 4, wherein said locking flange of said fence plate is located immediately below said top wall having said shackle openings therein and includes an inclined flange lip portion in underlapping alinement with the shackle opening for the shorter shackle leg, said flange lip portion extending in downwardly and outwardly declining relation to the extended axis of the shorter shackle leg when said shorter leg is in release position outwardly of the top wall and alined with its opening to be cammed by the free end of the shorter leg upon inward return movement of the shackle toward locking position and effect rocking of the fence plate about an axis different from said first pivot axis adequate to permit passage of the shorter shackle leg to said locking position alining the latching notch to receive the fence flange.

7. An exposed shackle padlock as defined in claim 1 wherein said rotatable locking mechanism comprises a manually operable combination lock mechanism including a dial assembly including a dial and a knob outwardly overlying a front wall of said casing journaled for rotation in said front wall, a shaft forming a tumbler post extending rearwardly through the casing in alinement with the center of the dial and pivot assembly, a plurality of circular tumbler wheels journaled for free rotation on said tumbler post each having a peripheral gate therein for receiving said fence flange when alined therewith and each having drive pins in a circular path about said post to intercept the drive pins of adjacent tumbler wheels for applying lost motion drive between adjacent tumbler wheels, and pin and socket coupling means for selectively intercoupling the dial assembly with the forwardmost tumbler wheel at a plurality of relative angular positions.

8. An exposed shackle padlock as defined in claim 4 wherein said rotatable locking mechanism comprises a manually operable combination lock mechanism including a dial assembly including a dial and a knob outwardly overlying a front wall of said casing journaled for rotation in said front wall, a shaft forming a tumbler post extending rearwardly through the casing in alinement with the center of the dial and pivot assembly, a plurality of circular tumbler wheels journaled for free rotation on said tumbler post each having a peripheral gate therein for receiving said fence flange when alined therewith and each having drive pins in a circular path about said post to intercept the drive pins of adjacent tumbler wheels for applying lost motion drive between adjacent tumbler wheels, and pin and socket coupling means for selectively intercoupling the dial assembly with the forwardmost tumbler wheel at a plurality of relative angular positions.

9. An exposed shackle padlock as defined in claim 5 wherein said rotatable locking mechanism comprises a manually operable combination lock mechanism including a dial assembly including a dial and a knob outwardly overlying a front wall of said casing journaled for rotation in said front wall, a shaft forming a tumbler post extending rearwardly through the casing in alinement with the center of the dial and pivot assembly, a plurality of circular tumbler wheels journaled for free rotation on said tumbler post each having a peripheral gate therein for receiving said fence flange when alined therewith and each having drive pins in a circular path about said post to intercept the drive pins of adjacent tumbler wheels for applying lost motion drive between adjacent tumbler wheels, and pin and socket coupling means for selectively intercoupling the dial assembly with the forwardmost tumbler wheel at a plurality of relative angular positions.

10. An exposed shackle padlock as defined in claim 7 wherein said knob includes a larger diameter knob portion and a smaller diameter hub portion having a plurality of circumferentially spaced teeth along the surface thereof, and said dial being an annular disc having a center opening sized to interfit on said hub portion and having a pair of teeth extending into the center opening of the dial to intermesh with the teeth of said hub portion, the number of teeth of the hub portion being much greater than the pair of teeth of the dial providing a large number of different relative angular positions in which the dial and hub can be assembled.

11. An exposed shackle padlock as defined in claim 8 wherein said knob includes a larger diameter knob portion and a smaller diameter hub portion having a plurality of circumferentially spaced teeth along the surface thereof, and said dial being an annular disc having a center opening sized to interfit on said hub portion and having a pair of teeth extending into the center opening of the dial to intermesh with the teeth of said hub portion, the number of teeth of the hub portion being much greater than the pair of teeth of the dial providing a large number of different relative angular positions in which the dial and hub can be assembled.

12. An exposed shackle padlock as defined in claim 9 wherein said knob includes a larger diameter knob portion and a smaller diameter hub portion having a plurality of circumferentially spaced teeth along the surface thereof, and said dial being an annular disc having a center opening sized to interfit on said hub portion and having a pair of teeth extending into the center opening of the dial to intermesh with the teeth of said hub portion, the number of teeth of the hub portion being much greater than the pair of teeth of the dial providing a large number of different relative angular positions in which the dial and hub can be assembled.

13. An exposed shackle padlock as defined in claim 1 including a lower lug formation on said fence plate spaced from said pivot and extending beneath a lower edge portion of said actuator plate to be engaged and forced downwardly by the lower edge portion of said actuator plate to rock the fence plate to unlatching position upon downward movement of the shackle toward the casing from said locking position when said tumbler wheel gate has been positioned to receive the fence flange.

14. An exposed shackle padlock as defined in claim 4 including a lower lug formation on said fence plate spaced from said pivot and extending beneath a lower edge portion of said actuator plate to be engaged and forced downwardly by the lower edge portion of said actuator plate to rock the fence plate to unlatching position upon downward movement of the shackle toward the casing from said locking position when said tumbler wheel gate has been positioned to receive the fence flange.

15. An exposed shackle padlock as defined in claim 7 including a lower lug formation on said fence plate spaced from said pivot and extending beneath a lower edge portion of said actuator plate to be engaged and forced downwardly by the lower edge portion of said actuator plate to rock the fence plate to unlatching position upon downward movement of the shackle toward the casing from said locking position when said tumbler wheel gate has been positioned to receive the fence flange.

16. An exposed shackle padlock as defined in claim 10 including a lower lug formation on said fence plate spaced from said pivot and extending beneath a lower edge portion of said actuator plate to be engaged and forced downwardly by the lower edge portion of said actuator plate to rock the fence plate to unlatching position upon downward movement of the shackle toward the casing from said locking position when said tumbler wheel gate has been positioned to receive the fence flange.

17. An exposed shackle padlock as defined in claim 15 wherein said tumbler wheels have serrations along the edges thereof, said longer shackle leg having a scrambler plate carried thereon to engage said serrations and move the tumbler wheels from the angular positions set to receive the fence flange during movement of the shackle from locking to released positions, and said actuator plate including means for rocking the fence plate to withdraw the fence flange from said gates immediately prior to engagement of the scrambler plate with the tumbler wheels.

18. An exposed shackle padlock as defined in claim 16 wherein said tumbler wheels have serrations along the edges thereof, said longer shackle leg having a scrambler plate carried thereon to engage said serrations and move the tumbler wheels from the angular positions set to receive the fence flange during movement of the shackle from locking to released positions, and said actuator plate including means for rocking the fence plate to withdraw the fence flange from said gates immediately prior to engagement of the scrambler plate with the tumbler wheels.

19. An exposed shackle padlock as defined in claim 7 wherein said tumbler wheels have serrations along the edges thereof, said longer shackle leg having a scrambler plate carried thereon to engage said serrations and move the tumbler wheels from the angular positions set to receive the fence flange during movement of the shackle from locking to released positions, and said actuator plate including means for rocking the fence plate to withdraw the fence flange from said gates immediately prior to engagement of the scrambler plate with the tumbler wheels.

20. An exposed shackle padlock as defined in claim 1 including a key lock override mechanism comprising a cylinder type key lock mounted in said casing immediately below the lower end of said shorter shackle leg, the key lock including a rotatable key plug having a keyway therein opening through a rear wall of the padlock casing to receive a key for rotation of the plug to an unlocking position by a properly shaped key, and a bolt member on said plug having a cam extension underlying the locking flange portion of said fence plate and shaped to abut and cam the locking flange in a direction to withdraw the locking flange from said latching notch and release the shackle for movement to release position.

21. An exposed shackle padlock as defined in claim 5 including a key lock override mechanism comprising a cylinder type key lock mounted in said casing immediately below the lower end of said shorter shackle leg, the key lock including a rotatable key plug having a keyway therein opening through a rear wall of the padlock casing to receive a key for rotation of the plug to an unlocking position by a properly shaped key, and a bolt member on said plug having a cam extension underlying the locking flange portion of said fence plate and shaped to abut and cam the locking flange in a direction to withdraw the locking flange from said latching notch and release the shackle for movement to release position.

22. An exposed shackle padlock as defined in claim 7 including a key lock override mechanism comprising a cylinder type key lock mounted in said casing immediately below the lower end of said shorter shackle leg, the key lock including a rotatable key plug having a keyway therein opening through a rear wall of the padlock casing to receive a key for rotation of the plug to an unlocking position by a properly shaped key, and a bolt member on said plug having a cam extension underlying the locking flange portion of said fence plate and shaped to abut and cam the locking flange in a direction to withdraw the locking flange from said latching notch and release the shackle for movement to release position.

23. An exposed shackle padlock as defined in claim 9 including a key lock override mechanism comprising a cylinder type key lock mounted in said casing immediately below the lower end of said shorter shackle leg, the key lock including a rotatable key plug having a keyway therein opening through a rear wall of the padlock casing to receive a key for rotation of the plug to an unlocking position by a properly shaped key, and a bolt member on said plug having a cam extension underlying the locking flange portion of said fence plate and shaped to abut and cam the locking flange in a direction to withdraw the locking flange from said latching notch and release the shackle for movement to release position.

24. An exposed shackle padlock as defined in claim 1 wherein said tumbler wheel member is a key operated disc cam having a key slot therein for rotation of the disc cam between a release position alining said gate to receive the fence flange and a normal locking position wherein an edge portion of the disc cam adjacent the fence flange bars movement of the fence plate to unlatching position, said casing having a key entry slot therein alined with the key slot in said disc cam, and said padlock having a plurality of ward disc members supported at stationary positions in a ward disc housing along the path of key movement into said key slot of the disc cam, the ward disc members having shaped key recesses therein accommodating rotation from a predetermined key entry position of only those keys having a predetermined shape to guard the disc cam against operation by an improper key.

25. An exposed shackle padlock as defined in claim 4 wherein said tumbler wheel member is a key operated disc cam having a key slot therein for rotation of the disc cam between a release position alining said gate to receive the fence flange and a normal locking position wherein an edge portion of the disc cam adjacent the fence flange bars movement of the fence plate to unlatching position, said casing having a key entry slot therein alined with the key slot in said disc cam, and said padlock having a plurality of ward disc members supported at stationary positions in a ward disc housing along the path of key movement into said key slot of the disc cam, the ward disc members having shaped key recesses therein accommodating rotation from a predetermined key entry position of only those keys having a predetermined shape to guard the disc cam against operation by an improper key.

26. An exposed shackle padlock as defined in claim 13 wherein said tumbler wheel member is a key operated disc cam having a key slot therein for rotation of the disc cam between a release position alining said gate to receive the fence flange and a normal locking position wherein an edge portion of the disc cam adjacent the fence flange bars movement of the fence plate to unlatching position, said casing having a key entry slot therein alined with the key slot in said disc cam, and said padlock having a plurality of ward disc members supported at stationary positions in a ward disc housing along the path of key movement into said key slot of the disc cam, the ward disc members having shaped key recesses therein accommodating rotation from a predetermined key entry position of only those keys having a predetermined shape to guard the disc cam against operation by an improper key.

27. An exposed shackle padlock as defined in claim 24, wherein said ward disc housing is a cup-shaped member having a slot in a front circular wall thereof for entry of a key and having a cylindrical wall extending rearwardly thereof surrounding and peripherally supporting said ward disc members and said disc cam in coaxial alinement.

28. An exposed shackle padlock as defined in claim 1, wherein said padlock casing is provided with a stationary lip formation having an end portion terminating in a straight edge for limiting shackle movement, the longer leg of the shackle having an elongated recess extending axially along a lower portion thereof for accommodating said end portion of the lip formation throughout the range of axial movement of the shackle between said locking and release positions, said recess defining a flat surface disposed immediately adjacent the straight edge of said lip formation over an inner portion of the range of axial shackle movement for preventing rotary displacement of the shackle from a predetermined position, and said longer shackle leg having a circumferential groove communicating with said recess to accommodate the end portion of the lip formation and permit rotation of the shackle about the axis of the longer leg only when the shorter shackle leg is located outwardly of the casing, said groove having a shoulder at the upper end thereof to engage the lip formation and prevent movement of the shackle to the inner locking position when the shorter shackle leg is misalined with its shackle opening.

29. An exposed shackle padlock as defined in claim 1, wherein said latching notch in the shorter shackle leg is a deep notch having downwardly convergent tapered sides both inclined at angles of in the range of about 30° to 60° relative to the axis of said shorter leg, and said locking flange having a lip portion seated in said notch in the locking position and disposed at an angle of about 45° to said shorter leg axis.

* * * * *